United States Patent [19]

Braun

[11] 3,953,998

[45] May 4, 1976

[54] MULTI-STAGE WIRE DRAWING MACHINE

[75] Inventor: Egon Braun, Haag near Schwabach, Germany

[73] Assignee: Maschinenfabrik, Niehoff KG, Schwabach, Germany

[22] Filed: July 31, 1974

[21] Appl. No.: 493,279

[30] Foreign Application Priority Data

Aug. 6, 1973 Germany ..... 2339691

[52] U.S. Cl. ..... 72/289

[51] Int. Cl.[2] ..... B21C 1/12

[58] Field of Search ..... 72/279, 288, 289, 443; 242/78

[56] References Cited

UNITED STATES PATENTS

| | | | |
|---|---|---|---|
| 824,655 | 6/1906 | Horton | 72/289 |
| 1,653,097 | 12/1927 | Hodgson | 72/289 |
| 1,973,596 | 9/1934 | Yousey | 72/289 |

FOREIGN PATENTS OR APPLICATIONS

| | | | |
|---|---|---|---|
| 609 | 10/1914 | United Kingdom | 72/289 |
| 1,144,673 | 3/1963 | Germany | 72/289 |

*Primary Examiner*—Milton S. Mehr
*Attorney, Agent, or Firm*—Murray Schaffer

[57] ABSTRACT

A multi-stage wire drawing machine having at least one drum formed with a plurality of sheaves over which the wire is sequentially pulled. The sheaves are disposed about a hollow sleeve in which is rotatably mounted a shaft connected at one end to a drive and at its other end to the farthermost sheave. The sheaves are interconnected by suitable gearing with each other and with the sleeve. The gearing is so adjusted that the peripheral speed of the individual sheaves increases in the direction of the passage of the wire, corresponding to the differential necessary to obtain only the least possible extension of the wire.

18 Claims, 4 Drawing Figures

| | SHAFT | SLEEVE |
|---|---|---|
| a | +657 | 0 |
| b | +616 | -9 |

| SHAFT | SLEEVE |
|---|---|
| +526 | 0 |
| +489 | -8 |

| SHAFT | SLEEVE |
|---|---|
| +3916 | 0 |
| +3916 | -66 |

| SHAFT | SLEEVE |
|---|---|
| +3132 | 0 |
| +3132 | -57 |

| SHAFT |
|---|
| 4777 |
| — |

SLIP ON DRAWING STAGES [%]
16
14
12
10
8
6
4
2
0
a'
LOSS OF WORK
(FRICTION)
b'
c
SLIP AL-
LOWED FOR
1
2
4
6
8
10
12
14
16
DIRECTION OF DRAWING
1st PAIR OF
SHEAVE DRUMS
2nd PAIR OF
SHEAVE DRUMS

| | SHAFT | SLEEVE |
|---|---|---|
| a | +657 | 0 |
| b | +616 | -9 |

| SHAFT | SLEEVE |
|---|---|
| +526 | 0 |
| +489 | -8 |

| SHAFT | SLEEVE |
|---|---|
| +3916 | 0 |
| +3916 | -66 |

| SHAFT | SLEEVE |
|---|---|
| +3132 | 0 |
| +3132 | -57 |

| SHAFT |
|---|
| 4777 |
| — |

MULTI-STAGE WIRE DRAWING MACHINE

BACKGROUND OF THE INVENTION

The present invention relates to a multi-stage wire drawing machine and, in particular, to a drum therefor having a plurality of sheaves over which the wire is pulled.

Multi-stage wire drawing machines, in general, comprise at least one pair of wire pulling drums over which the wire is pulled in alternate directions. Each of the drums is formed either as a continuous conical pulley or as a plurality of individual sheaves and is each preceded and followed by a wire extending die, over which the wire is sequentially attenuated and extended. In German Patent No. 940,974, an earlier machine having a drum is shown in which the wire first runs on the small diameter of a conical drawing die. Such apparatus have the advantage of requiring only a very small space. On the other hand, they possess a considerable drawback in that particularly thick wires are not uniformly stretched throughout their cross-section. In such machines the thick wire is inordinately attenuated in its peripheral or outer fibres and thus is drawn with inherent stressed conditions. In order to avoid this defect, apparatus has been designed having a drum provided with multiple-stage draw sheaves over which the wire is sequentially passed. Such a device shown in U.S. Pat. No. 1,973,596. In this patent, the drum is formed with a plurality of sheaves, each preceded by an individual wire extending die, which sheaves have the same uniform outer diameter. In this construction, the first and the last of the sheaves, in the direction of wire passage, are driven and the intermediate sheaves are coupled by a planetary gear transmission which includes a gear rim formed on each of the sheaves and a bevel pinion mounted rotatably therein. The sheaves thereby, have a complicated structure and their drive is most difficult. As a consequence the apparatus of the type shown in the aforementioned U.S. Patent has not found their way into practical use for this reason, as well as for other economical reasons related to their complex operation and maintenance.

Another multi-stage wire drawing machine has become known through the German Patent No. 1,144,673 in which all of the individual draw sheaves are provided with the same, but relatively large diameter. Because of the extremely large diameter of the draw sheaves used in his Patent, the advantage of a minimum space requirement is destroyed. Further, each of the draw sheaves are provided with only two bearing points, and additional shafts must be mounted within the draw plates by the use of two additional friction bearings located within bores inside the draw sheaves. These shafts are required to carry at each of their ends a spur gear having different numbers of teeth. The design of this latter German Patent is highly complicated and results in the formation of a number of wear points causing early breakdown of important parts. This greatly adds to the cost of the machine and its continued operation by the need of maintaining large stock of parts so that the machine may be easily and quickly repaired without extensive downtime.

In summary, it is observed that all of the known apparatus have numerous disadvantages, either draw sheaves of too small diameter, or when the diameter is dimensioned adequately, the cost of construction, the complexity of the machine and the space requirements are no longer within reasonable limits. Furthermore, due to the wear on the sheaves surfaces of the draw plates, in the machines heretofore know, their graduation has to be designed with a ratio or difference relative to the rated wire extension which disadvantageously results in the accumulation of a large slip factor. In particular the slip factor is most undesirable in those cases wherein the machines are provided with a rather large number of pulls on the wire. Consequently, a considerable loss of power results in the operation of the machine, coupled with considerable wear on the surfaces of the draw sheaves and actual damage to the surface of the wire. An attempt has been made to reduce the degree of slippage and therefore the loss of power. Reference is made to the Journal "Draht" Vol. 5, 1954, No. 8, Article on: "New Multiple Wire Drawing Machines With Reduced And Controlled Slip Of The Wire On The Draw Plates" by Walther Nacken in which is disclosed the fact that before and after each sheave a die or a "cone" is located and that each plate or sheave pulls the wire from the die or cone preceding it and supplies the wire to the next following die or cone. Each of the dies or cones has a tapered bore in which the wire is compressed and reduced in diameter and thus extended by a predetermined percentage. Attention should be particularly made of FIG. 1 of said Nacken's article wherein a reduction of slip is illustrated as being attained only in coarse and rough stages and only between two neighboring pairs of said cones. Within each pair of said cones, however, undesirable slip is encountered which has a greater degree than heretofore.

It is the object of the present invention to provide a wire drawing device overcoming the disadvantages and defects of the prior art.

It is another object of the present invention to provide a multi-stage wire drawing device which is simple in design and requires little maintenance.

It is a further object of the present invention to provide a wire drawing device utilizing a drum having multiple sheaves in which slip and loss of power is substantially reduced compared with the devices heretofore known.

It is a particular object of the present invention to provide a drum for a multi-stage wire drawing machine comprising a plurality of sheaves over which the wire sequentially passes which sheaves may be rotated in a predefined ratio with respect to the extension of the wire.

These objects, other objects, together with numerous advantages of the present invention will be apparent from the following disclosure.

SUMMARY OF THE INVENTION

A wire drawing machine is provided for pulling the progressively extended wire from a source thereof. The machine has at least one drum comprising a plurality of sheaves having preferably the same diameter and arranged successively to rotate about a common axis, the wire being adapted to be pulled sequentially over the periphery of each of said sheaves. The machine further comprises gearing means deriving their drive from the end one of the sheaves and interconnecting the remaining sheaves to rotate therewith. The gearing means is initially adjusted so that the peripheral speed of each of the sheaves increases successively from one sheave to the other in the direction of passage of said wire, so that the peripheral speed of each successive sheave substantially corresponds to the partial extension of the wire progressively occurring between two adjacent sheaves in the pulling direction of the wire.

The drawing machine comprises a central shaft, a sleeve surrounding the shaft and a plurality of sheaves disposed successively along said sleeve and rotatable thereabout. The central shaft is connected at one end to one of the sheaves and at the other end to drive means for rotating same.

According to the method of the present invention the foregoing objects and advantages are arrived at by adjusting and setting the speed ratio between the sheaves and the shaft so that the peripheral speeds of the individual sheaves, in the direction of the passage of the wire, for pulling the wire, increase from stage to stage, or sheave to sheave, in such a way that the increase in speed corresponds to the smallest partial extension of the wire, e.g. 25 percent. While the initial speed of all the sheaves is still low, the wire is drawn from each individual sheave and is progessively placed on the periphery of each following sheave. Thereafter, the ratio of speed of all of the sheaves, as rotated by the central shaft, is raised either incrementally or continuously to a sufficiently high speed for normal operation (=continuous operation), which corresponds to the mean or rated extension of the wire (e.g. 26 percent).

According to the present invention an efficient construction with the use of the simplest components is obtained by arranging the several sheaves in side by side condition in sequence about the sleeve and by providing each of the sheaves with an inner gear rim, and by connecting the farthermost sheave directly to the shaft. With the exception of the sheave nearest to the machanism for driving the shaft, each of the sheaves is provided with a sun gear attached to the sleeve and a planetary gear rotatively journaled in the adjacent sheave, which planetary gear meshes with both the sun gear and the associated gear rim of the sheave. In this manner a planetary gear coupling is provided between each of the adjacent sheaves creating the relative peripheral speed ratios desired.

In one form of construction the hollow sleeve is fixed and non-rotatable. In another form of construction, capable of making the slip in each drawing stage, be reduced to 0 or almost 0, the hollow shaft is rotatably mounted and capable of being driven with the central shaft, separately and independently, in such a way that the differential speed of the individual sheaves in relationship to one another is adjustably varied.

Further, in accordance with the present invention the drums formed of the plural sheaves may be arranged in plural pairs so that the wire is drawn in alternate directions. Each drum may have any number of sheaves. Thus, in order to ensure a more compact and therefore space-saving arrangement for the overall wire drawing apparatus, it is advantageous for the number of sheaves on at least one pair of drawing drums to be variable, as desired. Thus, a large number of sheaves may be placed on a single pair of drums eliminating the need for plural drums. To effect this, the sheaves are removably mounted on the hollow sleeves and are connected thereto by suitable keying means which provide conjoint rotation but unable axial removal.

Full details of the present invention are set forth in the following disclosure of its preferred embodiments, and are shown in the accompanying drawings.

DESCRIPTION OF THE INVENTION

Figure 1:
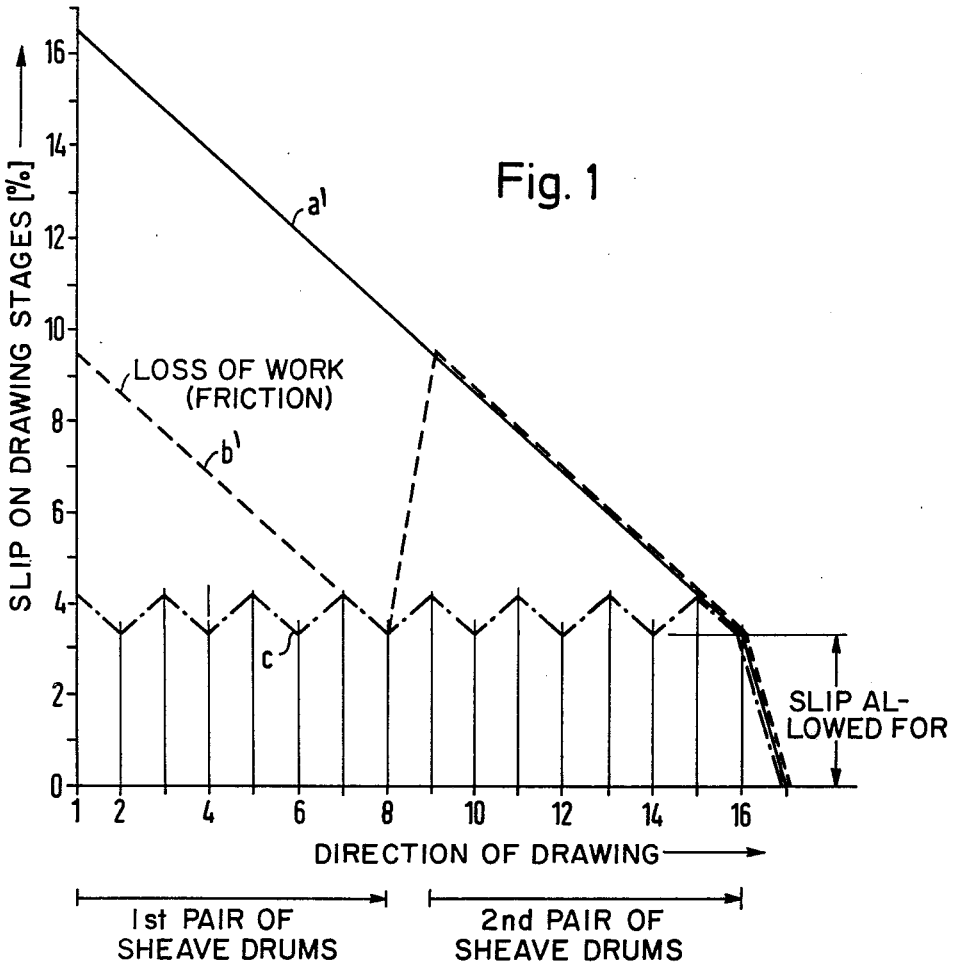
FIG. 1 is a graphical illustration comparing the slip conditions of wire drawing machines made in accordance with the prior art and of a wire drawing machine embodying the present invention.
Figure 4:
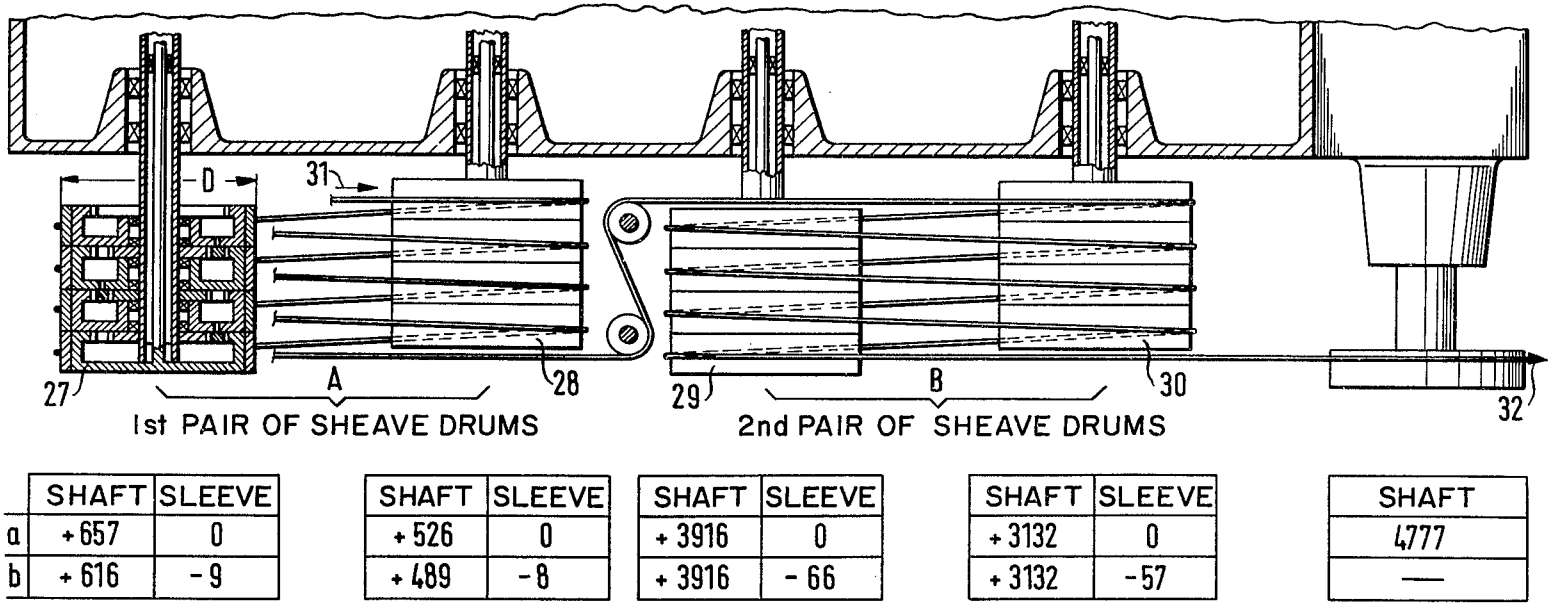
FIG. 4 shows an arrangement, in a wire drawing apparatus of two pair of drawing drums, each formed according to the principles of the present invention showing information relating to the shaft speeds during wire pulling, on the one hand in machines without the use of slip reduction means, i.e. with the fixed hollow shaft and on the other hand with the drum provided with slip reduction means, i.e. having a driven hollow shaft.

FIG. 1 illustrates graphically the degree of slip of the wire drawn over the drums of a drawing machine built according to two prior art methods as compared to the degree of slip of the wire drawn over a machine built in accordance with the present invention as illustrated in FIG. 4. Such a multi-stage drawing apparatus comprises two pair of drums each pair drawing the wire in alternate directions of movement. Each drum comprises four sheaves so that the wire is actually pulled in seventeen distinct stages. In the graph the ordinate axis indicaes the indicates degree of slip in each drawing stage while the abscissa axis denotes the actual number of stages. As seen, the continuous line, denoted by the letter *a* represents the slip in a machine not provided with means for slip reduction or the degree of slip with the pulling position on a machine having only some limited slip reduction means. The dashed line, denoted by the letter *b*, indicates the order of magnitude of reduction of slip, or lost work in terms of friction, that is possible with the slip reduction apparatus of the German Patent No. 940,974. Lastly, the graph shows in the dot-dash line, noted by the letter *c*, the considerable reduction in work lost (friction) which is capable in a drawing machine constructed in accordance with the present invention.

It will be seen from FIG. 1 that the amount of slip allowed for, is considerably reduced in the present invention over each stage of the wire pulling, as compared with the absence of reduction in the first of the prior art machines, indicated by the line *a*, or the variable degree of reduction provided in the devices of the aforementioned German Patent. As a result, a greater efficiency is obtained by the use of the present invention, and a more uniform drawing of the wire is obtained.

Figure 2:
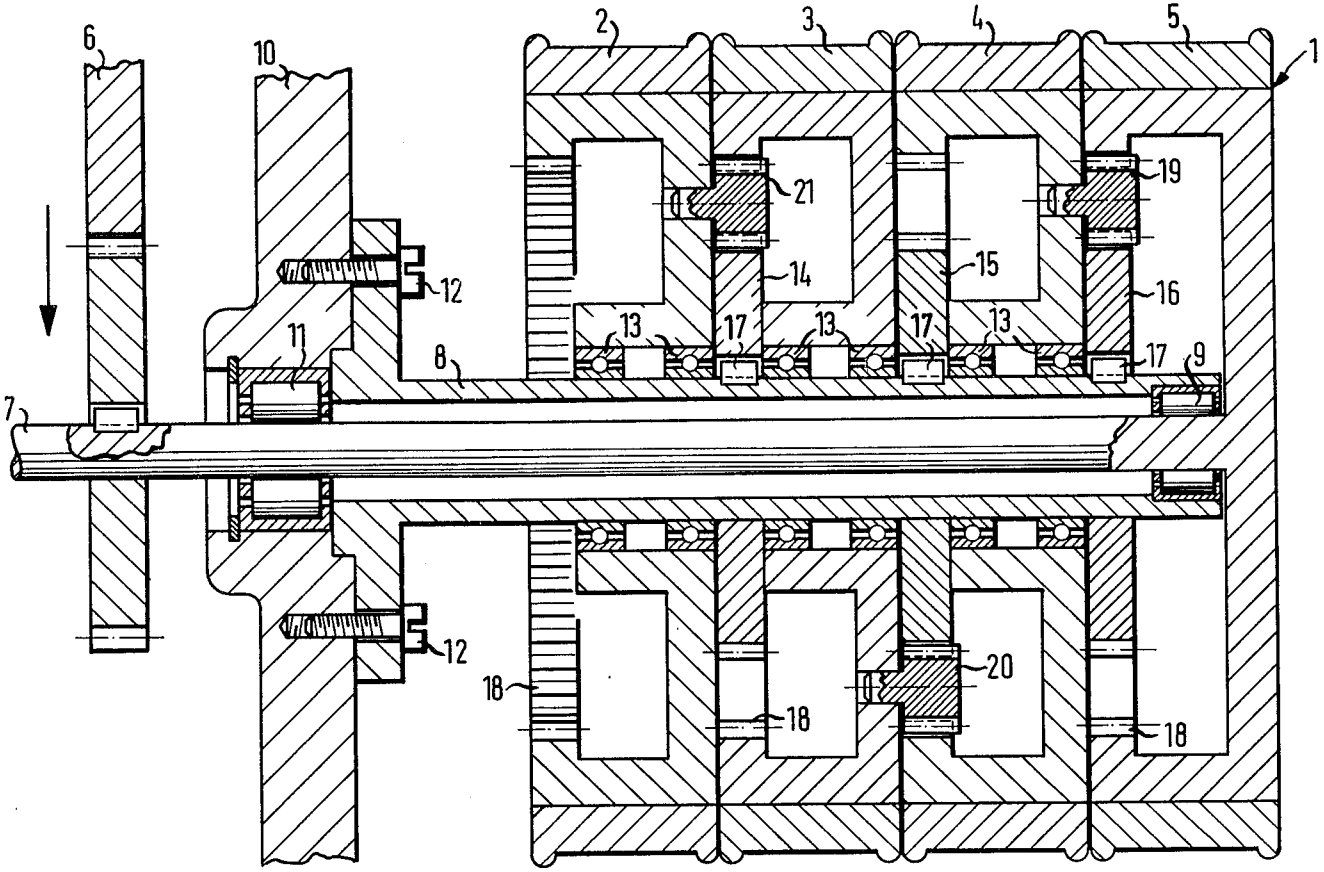
FIG. 2 is a sectional view, in elevational, of a drawing drum embodying the principles of the present invention having a solid central rotating shaft and a fixed stationary hollow shaft.

The advantages seen in FIG. 1 for the apparatus depicted in FIG. 4 is obtained by providing the drums of the wire drawing apparatus with the present invention. One such arrangement is seen in FIG. 2 wherein the drawing drum generally depicted by the numeral 1, is formed of a plurality of sheaves, particularly four in number, 2, 3, 4 and 5 each having the same outer diameter and design. The drums are driven by a principal drive apparatus comprising a suitable motor and gear transmission, indicated by the numeral 6, of conventional design. The drive means includes mean controls for varying the speed, the direction, etc. as is well known in the present art. The sheave 5, farthest from the drive end is integrally connected to an elongated shaft 7 which extends centrally through the drum. The shaft 7 is preferrably solid, although it need not be so, and is journaled concentrically in a hollow sleeve 8 by a radial bearing at its forward end. The shaft 7 extends through a stationary wall 10 which forms a portion of the housing or box for the gear transmission. The shaft 7 is borne by a radial bearing 11 at its rear end within the wall 10. The hollow sleeve, on the other hand, is rigidly and fixedly connected to the wall 10 by a plurality of bolts 12. A gear, meshing with the transmission gear 6 from the principal drive source, is keyed to the shaft 7 so as to transmit the rotation of the gear 6 into rotative movement of the shaft 7.

Each of the inner sheaves 2, 3 and 4 are journaled for rotation about the hollow sleeve 8 by suitable radial bearings 13 and have a substantially rectangular cross-section open along their rear ends, that is the end axially facing the wall 10. Between the forward end of each of the sheaves and the rearward end of the succeeding sheave 2, 3; 3, 4; and 4, 5 there is mounted a sun gear 14, 15 and 16 respectively, which is connected by a suitable key 17, or the like to the hollow sleeve 8. In this manner the sun gears 14, 15 and 16 are capable of conjoint rotation with the sleeve 8 but permit axial removal. The first sheave 2 may be held by a suitable retaining ring or the like on the sleeve 8. The sheaves, and their associated sun gears, are thus axially removable from the sleeve 8 and thus their number may be increased or descreased as desired.

The open end of each of the sheaves 2, 3, 4 and 5, is provided with an inwardly directed gear rim 18. Arranged between the gear rim 18 of the farthest sheave 5 and its oppositely associated sun gear 16 is a planetary gear 19 which has a central hub extending into and journaled in a conforming bore formed in the front end of the preceding sheave 4. The planetary gear 19 thus meshes with the sun gear 16 and the inwardly directed rim 18 of the sheave 5, and is rotatable about its own axis. Similarly, a planetary gear 20 and 21 respectively is located between each of the sheaves 4 and 3, and 3 and 2 in descending order rearwardly to the wall 10. In this manner a non-rigid, non-positive coupling or transmission between the sole driven sheave 5 and the other sheaves 2, 3 and 4 is obtained. No sun gear or planetary gear need be provided between the first sheave 2 and the sleeve 8 since the sheave 2 will be caused to rotate by the hub of the planetary gear 21. Operatively rotation of the central shaft 7 causes rotation of the farthermost sheave 5 which causes the subsequent rotation of the remaining sheaves 4, 3 and 2 in a relative order of peripheral speeds depending upon the gear ratio of the planetary gear system forming the coupling between the sheaves.

It is possible with the arrangement shown in FIG. 2 to reduce slippage of the wire over the sheaves, which sheaves have the same outer diameter and to obtain a defined slippage of the wire in the individual drawing stages dependent upon the ratio of peripheral speeds of the individual sheaves. It is, however, not possible with this arrangement to reduce slippage to nil or almost nil levels.

Figure 3:
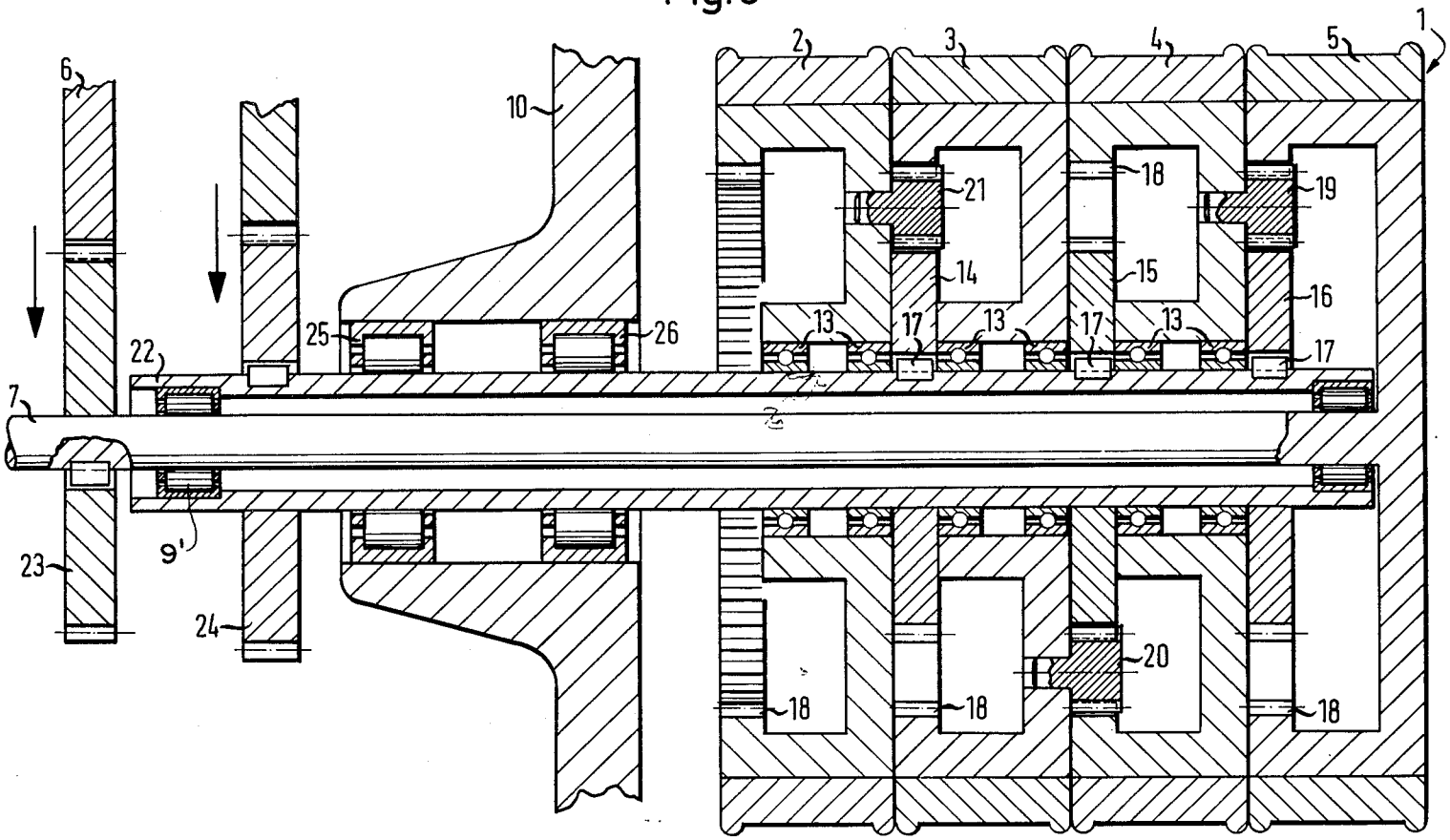
FIG. 3 is a view similar to that of FIG. 2 showing an embodiment of the present invention in which the hollow sleeve is rotatably driven.

This problem is, however, overcome by constructing the drum according to FIG. 3. In the construction, according to the present arrangement as seen in FIG. 3, the drum is substantially similar to that of FIG. 2 and in order to avoid unnecessary repetition of the description the same parts are given the same reference numbers and unless otherwise described function in the same manner. The difference between the arrangement of FIG. 3 and that of FIG. 2 lies in the fact that the improved results and benefits are obtained by driving both the solid central shaft and the concentric outer hollow sleeve. To this end the hollow sleeve, seen in FIG. 3, denoted by the numeral 22, is extended like the solid shaft 7 to pass through the wall 10 forming the gear box. The sleeve 22 is suitably journaled within the wall 10 by radial bearings 25 and 26 and by a second radial bearing 9' between it and the shaft 7 at its outer end. The shaft 7 is driven by a motor through the gear transmission 6, via a gear 23 while the hollow sleeve is driven by either the same motor means or an independent means through a gear 24 keyed to it. Suitable means are provided in the motor and the gear transmission to allow independent rotation of the sleeve relative to the shaft 7. As a result, the construction in FIG. 3, permits the use of sheaves having the same diameter, and thereby reducing the spacial requirements necessary and also avoiding the inherent slip problems in conical drums, the reduction of slippage to a 0 or at least close to 0 value is obtained by the ability to rotate both the central shaft 7 and the surrounding sleeve 22.

According to the present invention, the beneficial results in drawing the wire lies in the initial setting of each of the sheaves in the direction of passage of the wire, so that they rotate at a peripheral speed relative to the preceding sheave corresponding to the least possible extension of the wire during the period between the adjacent sheaves. That is the peripheral speed, in the direction of passage of the wire between two sheaves, corresponds substantially to the partial increase of the wire length occurring between two sheaves. The speed of rotation of the drum as a whole (i.e. in all the sheaves) is raised corresponding to the rated or mean average extension of the wire as a whole. This can be obtained by providing a predetermined definition of the gear ratios between the sun, planet and rim ears for each of the individual sheaves. In this manner, each of the sheaves will be caused to rotate by the rotation of the central shaft 7 at peripheral speeds relative to the preceding sheave in the manner desired.

In the following discussion: Z1 represents the number of teeth of the sun gears 14, 15 and 16; Z2 represents the number of teeth on the planetary gears 19, 20, and 21 and Z3 represents the number of teeth on the rim gear 18 of each sheave. If for example, a wire extension of 26 percent is desired, it would be customary to adopt a speed increase between the sheaves of the drum of 25 percent. This will take into account any small degree of slippage, if it may occur. The ratio of the increment in speed between the individual sheaves 2, 3, 4 and 5 (in the normal arrangement of paired drums alternately drawing the wire) would then be $1.25^2$ or would be equal to 1.5625. If it is to be assumed that the drum comprises four sheaves, I, II, III, and IV, and the farthermost outer sheave performs nI revolutions per minute, then $$(a) \qquad \frac{nI}{nII} = \frac{nII}{nIII} = \frac{nIII}{nIV} = 1.25^2 = 1.5625.$$

However, in general, the formula for obtaining the gear ratios, relative to the speed of rotation is:

$$(I) \qquad n_I = n_{II} \left(1 + \frac{Z_1}{Z_3}\right) - n_H \cdot \frac{Z_1}{Z_3},$$

where $n_I$ and $n_{II}$ are the RPM of the respective sheaves, $Z_1$ and $Z_3$ are the number of teeth on the sun and rim gears, respectively, and $n_H$ is the RPM of the hollow sleeve.

To define only the gear ratio, the hollow sleeve may be assumed to be stationary, so that $n_H$ is equal to zero. Therefore, the general formula can be reduced to $$(b) \qquad n_I = n_{II} \left(1 + \frac{Z_1}{Z_3}\right).$$

$$(b) \qquad nI = nII \left(1 + \frac{Z1}{Z3}\right); \quad \frac{nI}{nII} = 1 + \frac{Z1}{Z3} \times 1.5625.$$

Assuming that the hollow sleeve has a number of teeth Z1 = 54, there would then, for instance since found that:

$$(c) \qquad \frac{Z1}{Z3} = 1.5625 - 1 = 0.5625, \text{ from which, } Z3 = 96 \text{ teeth,}$$

$$\text{Sample: } \frac{54}{96} = 0.5625, \text{ and that}$$

$$(d) \qquad Z2 = \frac{Z3 - Z1}{2} = \frac{96 - 54}{2} = 21 \text{ teeth}$$

As a result of the foregoing computations it is clear that utilizing sheaves of equal outer diameter, the peripheral speeds of adjacents sheaves can be adjusted to correspond to the least or smallest possible extension of the wire (i.e. partial extension between successive sheaves). This relative peripheral speed will remain constant for all speeds of the shaft 7 and thus the wire will be drawn in a uniform manner during the period of time in which the speed of the drum as a whole is raised to correspond to the mean rated extension of the wire. In particular, a wire drawing machine can be provided having a drum in which sheaves having a diameter D of 200 mm and a selected module of M = 1.5 so that there is obtained for the appropriate range of wire diameters a suitable space saving arrangement which nevertheless does full justice to the practical demands of wire drawing.

Such a multi-stage, multi-drum wire drawing machine is shown in FIG. 4. As seen in FIG. 4 the machine comprises four drums 27, 28, 29 and 30, arranged in two pairs, A and B, over which the wire is alternately drawn. Each of the drums 27, 28, 29 and 30, comprise a plurality of four sheaves constructed in the manner described above with respect to FIG. 3 wherein both the central shaft 7 and the concentric hollow sleeve may be driven. The passage of the wire is denoted by the arrows 31 and 32 and is drawn onto the first drum 28 from a known conventional source and is withdrawn from the last drum 29 by a suitable pulley. The number of pulls, actually made on the wire as it moves in the path 31, 32 is as will be obvious seventeen. Below each drum, 27, 28, 29 and 30, FIG. 4 shows a comparison between the speeds of rotation and the solid central shaft and the outer hollow sleeve in two modes of operation. In the line *a* the speed of rotation of the respective shafts are shown where the wire is pulled over the sheaves arranged so that the hollow sleeve is stationary or in fixed condition. This may be obtained by firstly fixing the sleeve as shown in FIG. 2 or in the use of the apparatus shown in FIG. 3 by holding the sleeve 22 stationary. In the line *b* the speed of rotation of the central shaft and the outer hollow sleeve is shown during the pulling operation with the slip reduction method described in FIG. 3, i.e. with the sleeve being appropriately driven. The operative + and − signs depict the relative direction of rotation of the shaft and sleeve. By employing either the technique shown in line *a* or that shown in line *b* the advantages shown in FIG. 1 can be easily obtained.

The results of the present invention are not confined to the practical example shown but can be obtained by modification of the embodiments in a number of ways. For instance, the number of sheaves in each pair of drums can be varied at will. In particular, a very much larger number of sheaves can be assembled on any given shaft, of the drum so that a larger number of pulls can be made on the wire with any given single pair of drums. In this way, a reduction in the size of the drive motor and the main gear transmission can result. Also, a more compact form of construction is obtained since fewer drum pairs need be utilized. It is furthermore possible to arrange the drums so that the drawing tools, effecting the pull of the wire, extend in only one direction. That is, a pair of drums are arranged so that only the sheaves on one drum are used for drawing while those on the other drum are used merely for diverting the wire. In this case, only the increase in speed from one sheave to another on the same drum need be considered. Otherwise, as was foreseen from FIG. 4, the relationship in speed between the adjacent drum also must be controlled.

As noted earlier, the use of a solid central shaft and an outer hollow sleeve is made merely to denote the different types of shafts used in the practical example depicted. Instead of a solid central shaft, a suitably dimensioned tubular hollow shaft can be used.

Various other modifications and changes have been suggested in the foregoing disclosure. Other changes, modifications and embodiments will be obvious to those skilled in the art. It is accordingly intended that the present disclosure be taken as illustrative only and not limiting of the present invention.

What is claimed is:

1. The method of drawing wire on a wire drawing machine having a drum with a driving shaft, a sleeve surrounding said shaft, a plurality of sheaves sequentially disposed and rotatable about said sleeve over which sheaves said wire sequentially passes, comprising the steps of initially interconnecting each sheave in the direction of passage of the wire so as to conjointly rotate at a differential peripheral speed greater than the peripheral speed of the preceding sheave by an amount corresponding substantially to the partial extension of the wire occurring therebetween, initially rotating said sheaves at a lower speed ratio, sequentially passing the wire onto the periphery of each of the sheaves and hereafter simultaneously raising the speed of rotation of all of said sheaves in a ratio corresponding to the progressive extension of said wire occurring between each pair of adjacent sheaves.

2. The method according to claim 1 comprising the step of continuously increasing the speed ratio of all of the sheaves.

3. The method according to claim 1 comprising the step of increasing the speed ratio of all of said sheaves in predefined degrees.

4. Apparatus for drawing wire from a source, comprising a drum having a central shaft, a sleeve surrounding said central shaft, a plurality of sheaves disposed along and rotatable about said sleeve, over which sheaves said wire is adapted to be sequentially pulled, said central shaft being connected at one end to the end one of said sheaves and at its other end to means for rotating said shaft, and gear means, successively interconnecting said end one of said sheaves and each of said subsequent remaining sheaves to rotate each of said sheaves at a peripheral speed successively increasing in the direction of passage of said wire thereover by an amount corresponding substantially to the partial extension of said wire occurring between each pair of adjacent sheaves.

5. The apparatus according to claim 4 including means for controlling the speed of rotation of said shaft to continuously increase the same to a normal operation which corresponds to the extension of said wire occurring between each pair of adjacent sheaves.

6. The apparatus according to claim 4 including means for controlling the speed of rotation of said shaft to increase the same step by step to a normal operation which corresponds to the extension of said wire occurring between each pair of adjacent sheaves.

7. The apparatus according to claim 4 wherein said gear means comprises an inwardly directed gear rim on each of said sheaves and a sun gear keyed to said sleeve for each of said sheaves, except the sheave adjacent the end of said central shaft nearest the means for rotating the shaft and a planetary gear interposed between each of said sun gears and gear rims.

8. The apparatus according to claim 7 wherein said sleeve is fixedly mounted.

9. The apparatus according to claim 7 wherein said sleeve is rotatably mounted and includes means for driving said sleeve independently of said shaft.

10. The apparatus according to claim 9 including means for variably driving said sleeve relative to said shaft.

11. The apparatus according to claim 4 wherein said sheaves are removably keyed to said shaft whereby the number can be changed at will.

12. The wire drawing apparatus including at least one pair of drums, each of which is formed according to claim 1, said drums being arranged to alternately pull said wire from the dies interposed therebetween and having their central shafts rotated at different speeds.

13. The wire drawing apparatus according to claim 12 wherein the sleeve and central shaft of each drum is arranged to be rotated relative to each other at different speeds.

14. The wire drawing apparatus according to claim 12, wherein the sheaves of one drum are rotated in a direction opposite to the sheaves of the other drum in said pair.

15. The wire drawing apparatus according to claim 4, wherein all of said sheaves have the same diameter.

16. The wire drawing apparatus according to claim 12, wherein all of said sheaves have the same diameter.

17. Apparatus for drawing wire from a source comprising a plurality of sheaves having the same diameter and arranged successively to rotate about a common axis, said wire being adapted to be pulled sequentially over the periphery of each of said sheaves, means for rotating the end one of said sheaves, and means interconnecting said end one of said sheaves and each of the remaining sheaves to rotate said remaining sheaves therewith, said means being initially adjusted so that the peripheral speed of said sheaves increases successively from one sheave to the other in the direction of passage of said wire corresponding substantially to the partial extension of said wire progressively occurring between two adjacent sheaves in the pulling direction of the wire.

18. The method according to claim 1, including the step of mounting said sheaves arranged co-axially in a common drum having a central axis, all said sheaves having the same diameter.

* * * * *